US008482188B1

(12) United States Patent
Ma

(10) Patent No.: US 8,482,188 B1
(45) Date of Patent: Jul. 9, 2013

(54) SPARK PLUG ELECTRODE WITH NANOCARBON ENHANCED COPPER CORE

(75) Inventor: Shuwei Ma, Ann Arbor, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 13/524,054

(22) Filed: Jun. 15, 2012

(51) Int. Cl.
*H01T 13/32* (2006.01)

(52) U.S. Cl.
USPC ..... 313/141; 313/118; 313/140; 445/7

(58) Field of Classification Search
USPC ..... 313/118–143; 445/7
See application file for complete search history.

(56) References Cited

U.S. PATENT DOCUMENTS 3,356,882 A 12/1967 Hallauer et al.
4,093,887 A 6/1978 Corbach et al.
4,808,135 A 2/1989 Sakura et al.
5,578,894 A 11/1996 Oshima
6,533,629 B1 3/2003 Boehler et al.
7,197,804 B2 4/2007 Muller
7,224,108 B2 5/2007 Aisenbrey
7,872,405 B2 1/2011 Aisenbrey
2003/0151030 A1 8/2003 Gurin
2007/0132354 A1 6/2007 Scott et al.
2009/0136707 A1 5/2009 Ueno
2010/0284122 A1 11/2010 Yang et al.
2011/0005808 A1 1/2011 White et al.

*Primary Examiner* — Joseph L Williams
(74) *Attorney, Agent, or Firm* — Robert L. Stearns; Dickinson Wright, PLLC

(57) ABSTRACT

A spark plug 20 includes a center electrode 22 and a ground electrode 24 providing a spark gap 26 therebetween. At least one of the electrodes 22, 24, but preferably both electrodes 22, 24 include a clad surrounding a core. The clad includes at least one metal, such as nickel, iron, or cobalt. The core includes nanocarbon material embedded in a copper matrix 40 to increase the thermal conductivity and reduce the coefficient of thermal expansion of the core. The nanocarbon material includes a plurality of fibers 42, also referred to as particles, whisks, or tubes, each having a diameter of 1.0 to 150.0 nanometers and a length of 1 μm to 100 μm. The core includes the nanocarbon material in an amount of 0.1 to 10.0 wt. %.

18 Claims, 5 Drawing Sheets

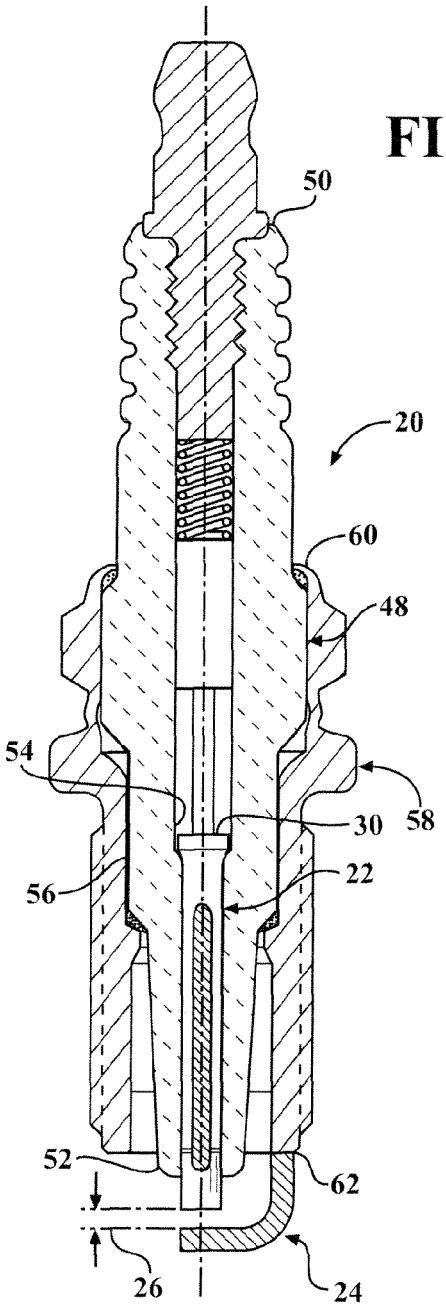
FIG. 1
FIG. 2
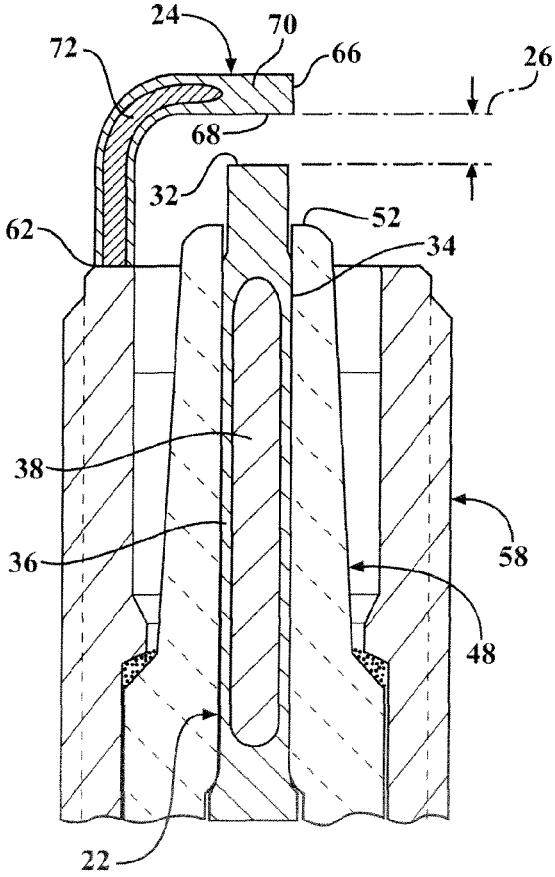

SPARK PLUG ELECTRODE WITH NANOCARBON ENHANCED COPPER CORE

BACKGROUND OF THE INVENTION

1. Field of the Invention

This invention relates generally to spark plug electrodes, particular to materials of the electrodes, and methods of forming the same.

2. Related Art

Spark plugs are widely used to initiate combustion in an internal combustion engine. Spark plugs typically include a ceramic insulator, a conductive shell surrounding the ceramic insulator, a center electrode disposed in the ceramic insulator, and a ground electrode operatively attached to the conductive shell. The electrodes each have a spark surface located proximate one another and defining a spark gap therebetween. Such spark plugs ignite gases in an engine cylinder by emitting an electrical spark jumping the spark gap between the center electrode and ground electrode, the ignition of which creates a power stroke in the engine. Due to the nature of internal combustion engines, spark plugs operate in an extreme environment of high temperature and various corrosive combustion gases and therefore should be fabricated of appropriate materials. When the electrodes are not fabricated of appropriate materials, the extreme working conditions may gradually increase the width of the spark gap between the center electrode and ground electrode, and may induce the misfire of spark plugs and cause subsequent loss of engine power and performance.

Spark plug electrodes often include a core formed of copper and a clad formed of at least one metal, such as a nickel alloy or at least one other metal having a coefficient of thermal expansion significantly lower than copper. The copper provides a high thermal conductivity and thus reduces the operating temperature of the electrode. The nickel alloys and other metals used to form the clad have good erosion and corrosion resistance. An example of an existing electrode includes a core formed of 100 wt % copper and a clad formed of a nickel alloy including 14.5-15.5 wt % chromium, 7.0-8.0 wt % iron, 0.2-0.5 wt % manganese, and 0.2-0.5 wt % silicon, and a balance of nickel.

The existing electrodes including a copper core and metal clad experience large temperature gradients when the engine runs between full throttle and idle operation. Oftentimes undesirable swelling, thermal mechanical stresses, and induced creep deformation occur because the copper core has a coefficient of thermal expansion significantly greater than the metal clad. The difference in coefficient of thermal expansion between the core and the clad is typically $4\times10^{-6}$/K.

FIGS. 10 and 11 show how a center electrode may deform during operation. When the temperate of the center electrode increases from room temperature to operating temperature, which is typically greater than 500° C., a compressive thermal stress builds up on the copper core because the coefficient of thermal expansion of copper is significantly greater than the coefficient of thermal expansion of the metal material of the clad. The copper core may undergo a time dependent creep deformation under the compressive axial stress. The creep deformation causes the copper core to shrink axially and expand radially.

The creep deformation of the copper core also causes the clad to compress. The clad has a geometrical constraint on the deformation of the copper core and thus expands radially from the solid line to the phantom line shown in FIG. 10. The radial expansion of the clad under this stress is also a creep process. This expansion causes a tension stress along the azimuthal direction and may cause cracks in the clad or in the surrounding insulator, as shown in FIGS. 10 and 11. The thermal stresses and associated axial shrinking and radial expansion repeats each time the engine runs, which may reduce the strength and performance of the center electrode. The thermal stresses and creep dependent deformation may also occur in the ground electrode, causing the spark surface of the ground electrode to shift away from the center electrode and the spark gap to increase.

SUMMARY OF THE INVENTION

One aspect of the invention provides a spark plug comprising a center electrode and a ground electrode presenting a spark gap therebetween. At least one of the electrodes includes a clad and a core, wherein the clad surrounds the core. The clad is formed of at least one metal. The core comprises a matrix including copper or a copper alloy and a nanocarbon material embedded in the copper matrix.

Another aspect of the invention provides a method of forming a spark plug. The method includes providing at least one of a center electrode and a ground electrode with a clad and a core, wherein the clad surrounds the core and is formed of at least one metal, and the core comprises a matrix of copper or a copper alloy with nanocarbon material embedded in the matrix.

The spark plug electrodes including the nanocarbon material embedded in the matrix provides high thermal conductivity and high temperature creep strength, which decreases the electrode temperature and improves resistance to swelling, compared to spark plug electrodes of the prior art. The nanocarbon fibers decrease the coefficient of thermal expansion of the core and thus reduce the difference between the coefficient of thermal expansion of the core and the clad, which in turn reduces the swelling of the core, reduces the thermal stresses on the core and clad, reduces growth of the spark gap between the center electrode and ground electrode, and reduces cracks in the clad and the insulator. The nanocarbon fibers also increase the thermal conductivity and high temperature creep strength of the electrode. Accordingly, the spark plug provides improved performance in the high temperature environment of an internal combustion engine.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 1 is a cross-sectional view of a spark plug according to one embodiment of the invention;

FIG. 2 is an enlarged view of a portion of the spark plug of FIG. 1

DETAILED DESCRIPTION

Figure 3:
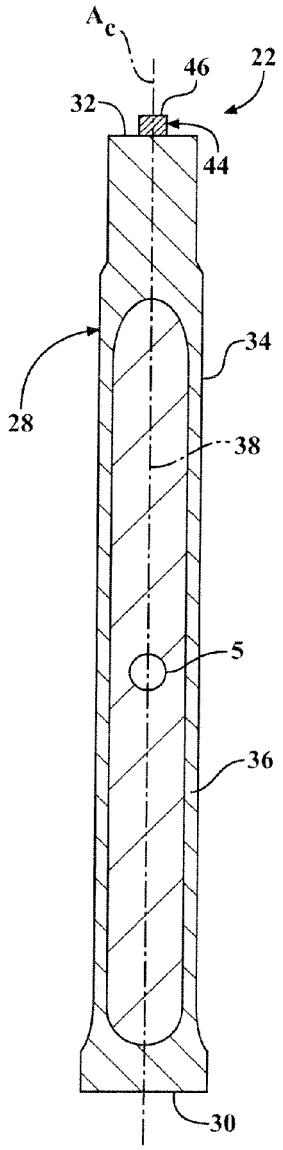
FIG. 3 is a cross-section view of a center electrode of a spark plug according to another embodiment of the invention.

One aspect of the invention comprises a spark plug 20 providing improved performance in a high temperature environment of an internal combustion engine. The spark plug 20 includes a center electrode 22 and a ground electrode 24 providing a spark gap 26 therebetween. At least one of the electrodes 22, 24, but preferably both of the electrodes 22, 24 include a metal clad surrounding a copper core, wherein nanocarbon material is embedded in the copper core. The core provides the electrodes 22, 24 exceptional strength and thermal conductivity, as well as improved resistance to swelling, creep, and thermal stress, compared to spark plug electrodes of the prior art. Thus, the spark plug 20 provides reduced growth of the spark gap 26 between the center electrode 22 and ground electrode 24. FIG. 1 shows an example of the spark plug 20 according to one embodiment of the invention.

The center electrode 22 of the spark plug 20 preferably includes the metal clad surrounding the copper core, wherein the nanocarbon material is embedded in the copper core. In this embodiment, the center electrode 22 includes a center body 28 extending longitudinally along a central electrode axis $A_c$ from a center terminal end 30 to a center firing end 32, as shown in FIG. 3. The center body 28 includes a center outer surface 34 extending circumferentially around and parallel to the center electrode axis $A_c$. The center outer surface 34 also extends continuously from the center terminal end 30 to the center firing end 32.

The center body 28 includes the clad, referred to as a center clad 36, surrounding the core, referred to as a center core 38. The center clad 36 is formed of at least one metal, such as nickel, iron, and cobalt. In one embodiment, the center clad 36 is formed of a nickel-based alloy, such as a Ni alloy including Al, Si, and Y; a Ni alloy including Cr; a Ni alloy including Cr, Mn, and Si; a Ni alloy including Cr, and Al; or a Ni alloy including Cr, Al, Mn, and Si. Nickel typically forms the balance of the center clad 36.

A first example of a nickel-based alloy used to form the center clad 36 is a dilute nickel-based alloy including Al, Si, and Y. The nickel-based alloy includes 1.0 wt. % to 1.5 wt. % Al; 1.0 wt. % to 1.5 wt. % Si; and 0.1 wt. % to 0.2 wt. % Y, based on the total weight of the alloy. The nickel-based alloy may also include trace amounts of other elements, such as Fe, Cr, C, Ti, Mn, Ca, Co, Sn, P, V, Nb, Mo, W, and Co. The nickel-based alloy of the first example has a thermal conductivity of at least 35 W/(m·K).

A second example of a nickel-based alloy used to form the center clad 36 is a dilute nickel-based alloy including Cr, Mn Si, Ti, and Zr. The nickel-based alloy includes 1.65 wt. % to 1.90 wt. % Cr; 1.8 wt. % to 2.1 wt. % Mn; 0.35 wt. % to 0.55 wt. % Si; 0.2 wt. % to 0.4 wt. % Ti; and 0.1 wt. % to 0.2 wt. % Zr, based on the total weight of the alloy. The nickel-based alloy may also include trace amounts of other elements, such as Fe and C. The nickel-based alloy of the second example has a thermal conductivity of at least 25 W/(m·K).

A third example of a nickel-based alloy used to form the center clad 36 is a solid solution strengthened nickel-based alloy including Cr and Fe. The nickel-based alloy includes 12 wt. % to 18 wt. % Cr; and 6 wt. % to 10 wt. % Fe, based on the total weight of the alloy. The nickel-based alloy may also include trace amounts of other elements, such as C, Mn, Si, S, and Cu. The nickel-based alloy of the third example has a thermal conductivity of at least W/(m·K).

A forth example of a nickel-based alloy used to form the center clad 36 is a solid solution strengthened nickel-based alloy including Cr, Fe, and Al. The nickel-based alloy includes 21 wt. % to 25 wt. % Cr; 10 wt. % to 16 wt. % Fe; and 1 wt. % to 2 wt. % Al, based on the total weight of the alloy. The nickel-based alloy may also include trace amounts of other elements, such as C, Mn, Si, S, and Cu. The nickel-based alloy of the forth example has a thermal conductivity of at least 10 W/(m·K).

The center core 38 of the center electrode 22 includes a matrix 40 formed of copper, such as pure copper or oxygen-free copper, or a copper alloy. The copper matrix 40 typically has a coefficient of thermal expansion greater than the coefficient of thermal expansion of the center clad 36. In one embodiment, the copper matrix 40 has a thermal conductivity of at least 350 W/(m·K); a coefficient of thermal expansion of about $13.8\times10^{-6}$/K at room temperature.

Figure 5:
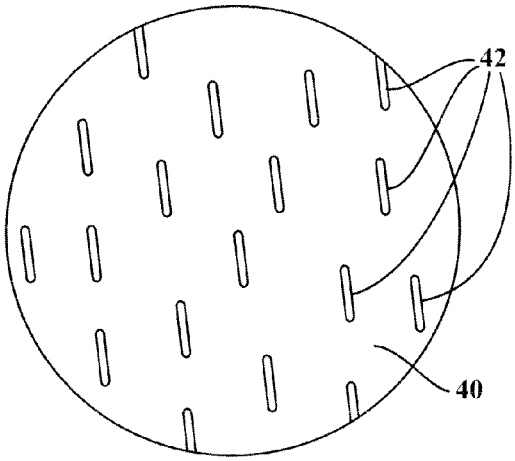
FIG. 5 is an enlarged view of a portion of a core of the center electrode of FIG. 3.
Figure 7:
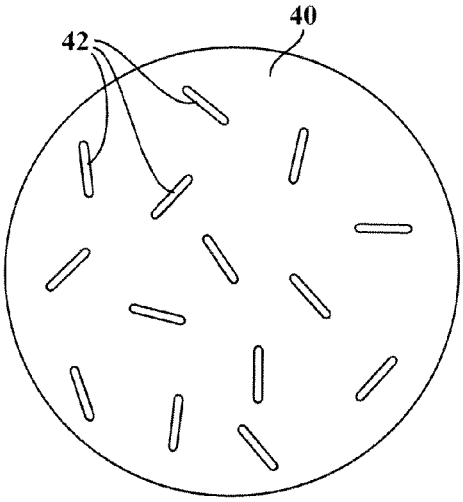
FIG. 7 is an enlarged view of a portion of a core of a center electrode according to another embodiment of the invention.
Figure 9:
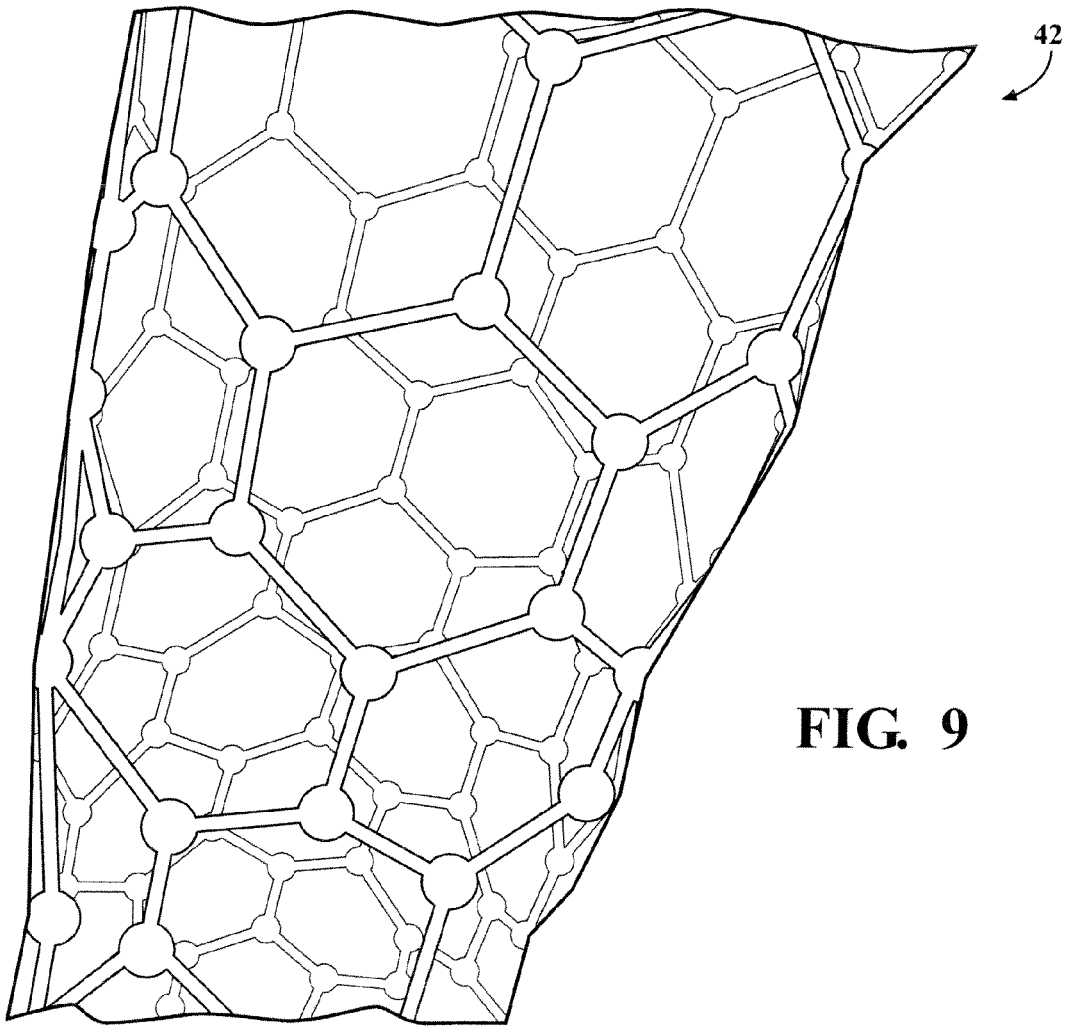
FIG. 9 is a magnified view of nanocarbon material according to one embodiment of the invention.
Figure 10:
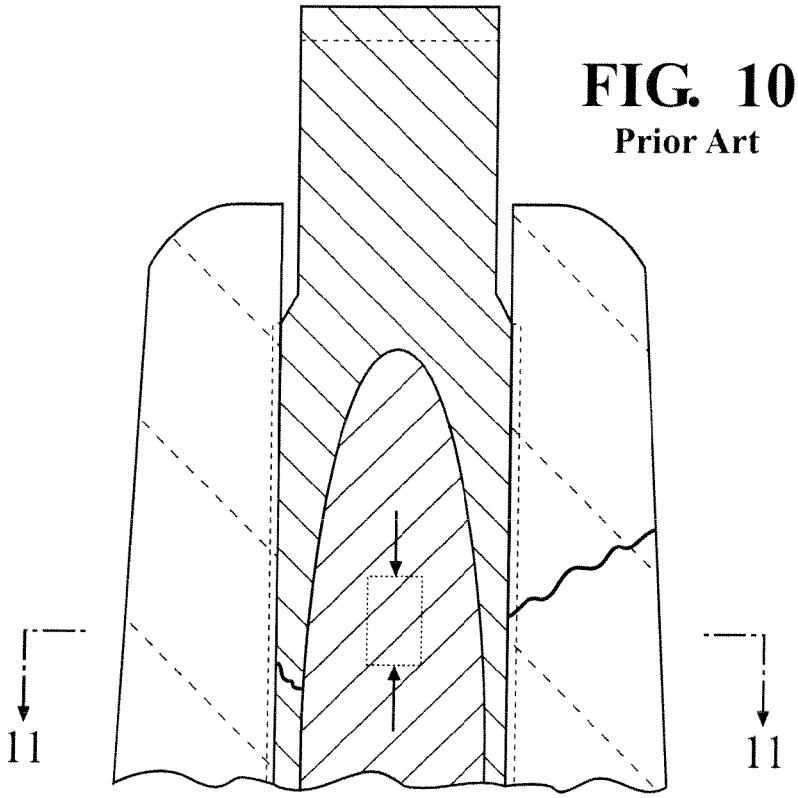
FIG. 10 Prior Art
FIG. 10 is a cross-sectional view of a portion of a spark plug of the prior art showing a crack in the insulator due to swelling of electrode.
Figure 11:
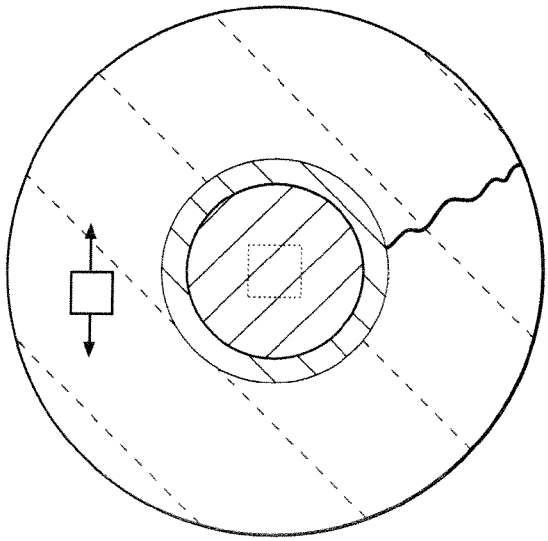
FIG. 11 Prior Art
FIG. 11 is a cross-sectional view of a portion of the spark plug of FIG. 10 along line 11.

The center core 38 also includes the nanocarbon material embedded in the copper matrix 40. In one embodiment, the nanocarbon material is present in an amount of 0.1 to 10.0 wt. %, based on the total weight of the center core 38. The nanocarbon material includes a plurality of fibers 42, also referred to as particles, whisks, or tubes. In one embodiment, each fiber 42 has a diameter of 1.0 to 150.0 nanometers and a length of 1 μM to 100 μm. Further, each fiber 42 typically comprises at least one sheet of carbon atoms extending circumferentially around a center axis, wherein each sheet is a mesh of the carbon atoms spaced from one another such that the carbon atoms present a plurality of interconnected hexagonal shapes. An example of a portion of one fiber 42 is shown in FIG. 9. Each fiber 42 may alternatively comprise a plurality of sheets each extending circumferentially around the center axis. In one embodiment, the fibers 42 extend parallel to one another and parallel to the center outer surface 34, as shown in FIG. 5. In another embodiment, the fibers 42 extend at angles relative to one another and relative to the center outer surface 34, as shown in FIG. 7. However, exceptionally high thermal conductivity is achieved when the fibers 42 extend parallel to the center outer surface 34.

In one embodiment, the nanocarbon material has a tensile strength of 10 to 150 GPa; a thermal conductivity of 1000 to 3500 W.m/K; and a coefficient of thermal expansion of $2.7\times10^{-6}$/K to $4.6\times10^{-6}$/K. Thus, the nanocarbon material increases the high temperature creep strength, increases the thermal conductivity, especially thermal conductivity in axial direction, and reduces the coefficient of thermal expansion of the center core 38. In one embodiment, the center core 38 of the center electrode 22, including the nanocarbon materials embedded in the copper matrix 40, has a thermal conductivity of 400 to 600 W.m/K.

The center electrode 22 may also include a center spark tip 44 disposed on the center firing end 32, as shown in FIG. 3. The center spark tip 44 includes a center spark surface 46 facing the ground electrode 24 and providing the spark gap 26. The center spark tip 44 typically includes at least one precious metal or alloy, such as platinum, rhodium, iridium, ruthenium, palladium, and their alloys.

The spark plug 20 also typically includes an insulator 48 disposed annularly around the center outer surface 34 of the center electrode 22 and extending longitudinally along the center outer surface 34 from an insulator top end 50 to an insulator nose end 52, as shown in FIG. 1. The insulator 48 typically extends longitudinally past the center terminal end 30 of the center electrode 22 and toward the center firing end 32 such that the center firing end 32 extends outwardly of the insulator nose end 52, also shown in FIG. 1. The insulator 48 includes an insulator inner surface 54 extending continuously from the insulator top end 50 to the insulator nose end 52 and engaging the center outer surface 34 of the center electrode 22. The insulator 48 also includes an oppositely facing insulator outer surface 56 extending continuously from the insulator top end 50 to the insulator nose end 52.

The insulator 48 is formed of an electrically insulating material, such as a ceramic material including alumina. The insulator 48 has an electrical conductivity less than the electrical conductivity of the electrodes 22, 24 and the shell 58. The insulator 48 also has a relative permittivity capable of holding an electrical charge.

The spark plug 20 also typically includes a shell 58 disposed annularly around the insulator outer surface 56, as shown in FIG. 1. The shell 58 extends longitudinally along the insulator outer surface 56 from a shell upper end 60 to a shell lower end 62. The shell 58 is formed of a metal material, such as steel.

Figure 4:
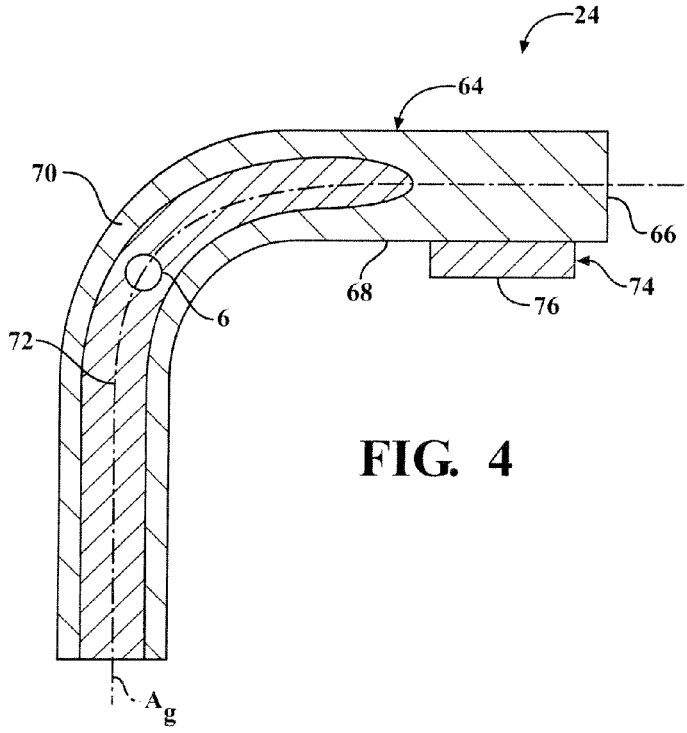
FIG. 4 is a cross-sectional view of a ground electrode of a spark plug according to another embodiment of the invention.

The ground electrode 24 also preferably includes the metal clad surrounding the copper core, wherein nanocarbon material is embedded in the copper core, to provide exceptional high temperature creep strength and thermal conductivity, which can improve resistance to swelling, compared to spark plug electrodes of the prior art. As shown in FIGS. 1, 2, and 4, the ground electrode 24 includes a ground body 64 extending from the shell lower end 62 toward the center spark surface 46 and to a ground firing end 66. The ground body 64 includes a ground outer surface 68 extending circumferentially around a ground electrode axis $A_g$ and continuously from the shell lower end 62 to the ground firing end 66. As shown in FIG. 4, the ground electrode axis $A_g$ curves toward the center firing end 32.

The ground body 64 preferably includes the clad, referred to as a ground clad 70, surrounding the core, referred to as the ground core 72. The ground clad 70 and the ground core 72 may have the composition and characteristics of the center clad 36 and center core 38. The ground clad 70 is formed of at least one metal, such as nickel, iron, and cobalt. In one embodiment, the ground clad 70 is fog wed of a nickel-based alloy, such as a Ni alloy including Al, Si, and Y; a Ni alloy including Cr; a Ni alloy including Cr, Mn, and Si; a Ni alloy including Cr, and Al; or a Ni alloy including Cr, Al, Mn, and Si. Nickel typically forms the balance of the ground clad 70.

A first example of a nickel-based alloy used to form the ground clad 70 is a dilute nickel-based alloy including Al, Si, and Y. The nickel-based alloy includes 1.0 wt. % to 1.5 wt. % Al; 1.0 wt. % to 1.5 wt. % Si; and 0.1 wt. % to 0.2 wt. % Y, based on the total weight of the alloy. The nickel-based alloy may also include trace amounts of other elements, such as Fe, Cr, C, Ti, Mn, Ca, Co, Sn, P, V, Nb, Mo, W, Co, and Ni. The nickel-based alloy of the first example has a thermal conductivity of at least 35 W/(m·K).

A second example of a nickel-based alloy used to form the ground clad 70 is a dilute nickel-based alloy including Cr, Mn Si, Ti, and Zr. The nickel-based alloy includes 1.65 wt. % to 1.90 wt. % Cr; 1.8 wt. % to 2.1 wt. Mn; 0.35 wt. % to 0.55 wt. % Si; 0.2 wt. % to 0.4 wt. % Ti; and 0.1 wt. % to 0.2 wt. % Zr, based on the total weight of the alloy. The nickel-based alloy may also include trace amounts of other elements, such as Fe and C. The nickel-based alloy of the second example has a thermal conductivity of at least 25 W/(m·K).

A third example of a nickel-based alloy used to form the ground clad 70 is a solid solution strengthened nickel-based alloy including Cr and Fe. The nickel-based alloy includes 12 wt. % to 18 wt. % Cr; and 6 wt % to 10 wt. % Fe, based on the total weight of the alloy. The nickel-based alloy may also include trace amounts of other elements, such as C, Mn, Si, S, and Cu. The nickel-based of the third example has a thermal conductivity of at least 14 W/(m·K).

A forth example of a nickel-based alloy used to form the ground clad 70 is a solid solution strengthened nickel-based alloy including Cr, Fe, and Al. The nickel-based alloy includes 21 wt. % to 25 wt. % Cr; 10 wt. % to 16 wt. % Fe; and 1 wt. % to 2 wt. % Al, based on the total weight of the alloy. The nickel-based alloy may also include trace amounts of other elements, such as C, Mn, Si, S, and Cu. The nickel-based of the forth example has a thermal conductivity of at least 10 W/(m·K).

The ground core 72 of the ground electrode 24 includes the matrix 40 formed of copper, such as pure copper or oxygen-free copper, or a copper alloy. The copper matrix 40 has a coefficient of thermal expansion greater than the coefficient of thermal expansion of the ground clad 70. In one embodiment, the copper matrix 40 has a thermal conductivity of at least 350 W/(m·K); a coefficient of thermal expansion of at least $14\times10^{-6}$/K at room temperature.

Figure 6:
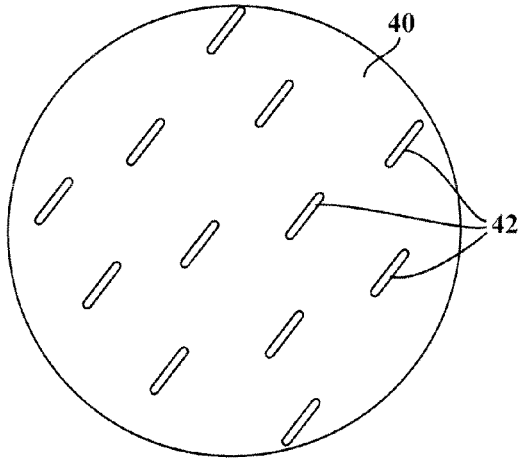
FIG. 6 is an enlarged view of a portion of a core of the ground electrode of FIG. 4.
Figure 8:
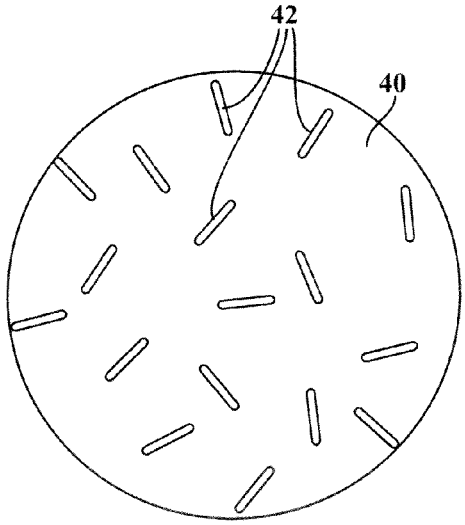
FIG. 8 is an enlarged view of a portion of a core of a ground electrode according to another embodiment of the invention.

The ground core 72 also includes the nanocarbon material embedded in the copper matrix 40. In one embodiment, the nanocarbon material is present in an amount of 0.1 to 10.0 wt. %, based on the total weight of the ground core 72. The nanocarbon material includes a plurality of fibers 42, also referred to as particles, whisks, or tubes. In one embodiment, each fiber 42 has a diameter of 1.0 to 150.0 nanometers and a length of 1 μm to 100 μm. Further, each fiber 42 typically comprises at least one sheet of carbon atoms extending circumferentially around a center axis, wherein each sheet is a mesh of the carbon atoms spaced from one another such that the carbon atoms present a plurality of interconnected hexagonal shapes. An example of a portion of one fiber 42 is shown in FIG. 9. Alternatively, the fiber 42 may comprise a plurality of sheets each extending circumferentially around the center axis. In one embodiment, the fibers 42 extend parallel to one another and parallel to the ground outer surface 68, as shown in FIG. 6. In another embodiment, the fibers 42 extend at angles relative to one another and relative to the ground outer surface 68, as shown in FIG. 8. However, exceptionally high thermal conductivity is achieved when the fibers 42 extend parallel to the ground outer surface 68.

In one embodiment, the nanocarbon material has a tensile strength of 10 to 150 GPA; a thermal conductivity of 1000 to 3500 W.m/K; and a coefficient of thermal expansion of $2.7\times10^{-6}$ to $4.6\times10^{-6}$/K. Thus, the nanocarbon material increases the high temperature creep strength, increases the thermal conductivity, especially thermal conductivity in axial direction, and reduces the coefficient of thermal expansion of the ground core 72. In one embodiment, the ground core 72 of the ground electrode 24, including the nanocarbon materials embedded in the copper matrix 40, has a thermal conductivity of 400 to 600 W.m/K.

The ground electrode 24 may also include a ground spark tip 74 disposed on the ground outer surface 68 adjacent the ground firing end 66, as shown in FIG. 4. The ground spark tip 74 presents a ground spark surface 76 facing the center electrode 22 and presenting the spark gap 26 therebetween. The ground spark tip 74 includes at least one precious metal or alloy, such as platinum, rhodium, iridium, ruthenium, palladium and their alloys.

Another aspect of the invention provides a method of forming a spark plug 20. The method includes providing at least one of a center electrode 22 and a ground electrode 24 with a clad and a core. The clad surrounds the core and is formed of at least one metal. The core includes a matrix 40 of copper or a copper alloy and a nanocarbon material embedded in the matrix 40. The method may include embedding the nanocarbon material in the copper matrix 40 to provide at least one of the electrodes 22, 24. The method may also include aligning fibers 42 of the nanocarbon material with an outer surface of the electrode. The aligning step may be conducted by extruding the core with the fibers 42 aligned in the direction of extrusion.

Obviously, many modifications and variations of the present invention are possible in light of the above teachings and may be practiced otherwise than as specifically described while within the scope of the appended claims.

ELEMENT LIST

| Element Symbol | Element Name |
|---|---|
| 20 | spark plug |
| 22 | center electrode |
| 24 | ground electrode |
| 26 | spark gap |
| 28 | center body |
| 30 | center terminal end |
| 32 | center firing end |
| 34 | center outer surface |
| 36 | center clad |
| 38 | center core |
| 40 | matrix |
| 42 | fibers |
| 44 | center spark tip |
| 46 | center spark surface |
| 48 | insulator |
| 50 | insulator top end |
| 52 | insulator nose end |
| 54 | insulator inner surface |
| 56 | insulator outer surface |
| 58 | shell |
| 60 | shell upper end |
| 62 | shell lower end |
| 64 | ground body |
| 66 | ground firing end |
| 68 | ground outer surface |
| 70 | ground clad |
| 72 | ground core |
| 74 | ground spark tip |
| 76 | ground spark surface |
| $A_c$ | center electrode axis |
| $A_g$ | ground electrode axis |

What is claimed is:

1. A spark plug comprising:

a center electrode and a ground electrode presenting a spark gap therebetween;

at least one of said electrodes including a clad and a core, wherein said clad surrounds said core, said clad is formed of at least one metal, and said core includes a matrix of copper or a copper alloy; and said core including a nanocarbon material embedded in said matrix.

2. The spark plug of claim 1 wherein said nanocarbon material includes at least one sheet of carbon atoms extending circumferentially around a center axis.

3. The spark plug of claim 1 wherein said sheet is a mesh of said carbon atoms spaced from one another and presenting a plurality of interconnected hexagonal shapes.

4. The spark plug of claim 1 wherein each of said nanocarbon materials have a diameter of 1.0 to 150.0 nanometers.

5. The spark plug of claim 1 wherein each of said nanocarbon materials have a length of 1 μm to 100 μm.

6. The spark plug of claim 1 wherein said at least one electrode including said nanocarbon material further includes an outer surface, and wherein said nanocarbon material extends parallel to said outer surface.

7. The spark plug of claim 1 wherein said at least one electrode including said nanocarbon material further includes an outer surface, and wherein said nanocarbon material extends at angles relative to said outer surface.

8. The spark plug of claim 1 wherein said core has a thermal conductivity of 400 to 600 W.m/K.

9. The spark plug of claim 1 wherein said clad has a coefficient of thermal expansion of 11 to $13\times10^{-6}$/K.

10. The spark plug of claim 1 including an insulator disposed annularly around said center electrode.

11. The spark plug of claim 1 wherein said copper matrix has a coefficient of the thermal expansion greater than a coefficient of thermal expansion of said clad.

12. The spark plug of claim 1 wherein said clad includes at least one of nickel, iron, and cobalt.

13. The spark plug of claim 1 wherein said center electrode and said ground electrode both include said clad and said core with a nanocarbon material embedded in said copper matrix.

14. The spark plug of claim 1 wherein said nanocarbon material includes a plurality of fibers, particles, whisks, or tubes.

15. A method of forming a spark plug comprising the steps of:

providing at least one of a center electrode and a ground electrode with a clad and a core, wherein the clad surrounds the core, the clad is formed of at least one metal, the core includes a matrix of copper or a copper alloy; and the core includes a nanocarbon material embedded in a copper matrix.

16. The method of claim 15 including embedding the nanocarbon material in the copper matrix.

17. The method of claim 15 including aligning the nanocarbon material with an outer surface of the electrode.

18. A spark plug comprising:

a center electrode including a center body extending longitudinally along a central electrode axis from an center terminal end to a center firing end;

said center body including a center outer surface extending circumferentially around and parallel to said center electrode axis and extending continuously from said center terminal end to said center firing end;

said center body including a center clad surrounding a center core;

said center clad including at least one of a nickel, iron, and cobalt;

said center core including a copper matrix formed of copper or a copper alloy;

said copper or copper alloy of said copper matrix including pure copper or oxygen-free copper;

said copper matrix having a coefficient of thermal expansion greater than the coefficient of thermal expansion of said center clad;

said copper matrix having a thermal conductivity of at least 350 W/(m·K);

said center core including nanocarbon material embedded in said copper matrix;

said nanocarbon material including a plurality of fibers, each fiber including at least one sheet of carbon atoms extending circumferentially around a center axis, said sheet being a mesh of said carbon atoms spaced from one another to present a plurality of interconnected hexagonal shapes;

each of said fibers having a diameter of 1.0 to 150.0 nanometers;

each of said fibers having a length of 1 μm to 200 μm;

each of said fibers having a tensile strength of 10 to 150 GPa;

each of said fibers having a thermal conductivity of 400 to 600 W.m/K;

each of said fibers having a coefficient of thermal expansion of $2.7\times10^{-6}$ to $4.6\times10^{-6}$ W.m/K;

said center core including said nanocarbon material in an amount of 0.1 to 10.0 wt. %, based on the total weight of said center core;

said center core having a thermal conductivity of 400 to 600 W.m/K;

said center electrode including a center spark tip disposed on said center firing end and presenting a center spark surface;

said center spark tip including at least one precious metal;

an insulator formed of an electrically insulating material disposed annularly around said center outer surface and extending longitudinally along said center outer surface from an insulator top end to an insulator nose end;

said insulating material including alumina;

said insulator extending longitudinally past said center terminal end and toward said center firing end such that said center firing end extends outwardly of said insulator nose end;

said insulator including an insulator outer surface extending continuously from said insulator top end to said insulator nose end and an oppositely facing insulator inner surface engaging said center outer surface;

a shell formed of a metal material disposed annularly around said insulator outer surface and extending longitudinally along said insulator outer surface from a shell upper end to a shell lower end;

a ground electrode including a ground body extending from said shell lower end toward said center spark surface and to a ground firing end;

said ground body including a ground outer surface extending circumferentially around a ground electrode axis and continuously from said shell lower end to said ground firing end;

said ground electrode axis curving from said shell lower end toward said center spark surface;

said ground body including a ground clad surrounding a ground core;

said ground clad including at least one of a nickel, iron, and cobalt; and said ground core including said nanocarbon material embedded in said copper matrix.

* * * * *